US007320160B2

(12) United States Patent
Uehara et al.

(10) Patent No.: US 7,320,160 B2
(45) Date of Patent: Jan. 22, 2008

(54) BUCKLE

(75) Inventors: Ryoichiro Uehara, Kurobe (JP); Hiroshi Matoba, Toyama (JP)

(73) Assignee: YKK Corporation, Tokyo (JP)

( * ) Notice: Subject to any disclaimer, the term of this patent is extended or adjusted under 35 U.S.C. 154(b) by 65 days.

(21) Appl. No.: 11/264,070

(22) Filed: Nov. 1, 2005

(65) Prior Publication Data

US 2006/0090310 A1 May 4, 2006

(30) Foreign Application Priority Data

Nov. 2, 2004 (JP) ..... 2004-319903

(51) Int. Cl.
*A44B 11/25* (2006.01)

(52) U.S. Cl. ..... 24/615; 24/614; 24/625; 24/662

(58) Field of Classification Search ..... 24/614, 24/615, 616, 625, 662
See application file for complete search history.

(56) References Cited

U.S. PATENT DOCUMENTS

| | | | | |
|---|---|---|---|---|
| 4,688,337 | A * | 8/1987 | Dillner et al. | 24/616 |
| 5,507,076 | A | 4/1996 | Anscher | |
| 5,926,928 | A | 7/1999 | Lundstedt | |
| 5,953,798 | A * | 9/1999 | Matoba et al. | 24/615 |
| 6,301,757 | B1 * | 10/2001 | Kunii et al. | 24/636 |
| 6,311,374 | B1 * | 11/2001 | Anscher | 24/625 |
| D468,233 | S * | 1/2003 | Della Valle | D11/216 |
| 7,100,252 | B2 * | 9/2006 | Anscher | 24/615 |
| 2002/0040514 | A1 * | 4/2002 | Uehara et al. | 24/614 |
| 2005/0235469 | A1 * | 10/2005 | Anscher | 24/615 |
| 2006/0168783 | A1 * | 8/2006 | Anscher | 24/615 |

FOREIGN PATENT DOCUMENTS

| | | |
|---|---|---|
| EP | 0466446 | 1/1992 |
| EP | 1325690 | 7/2003 |
| JP | 2003-284606 | 10/2003 |
| RU | 586823 | 12/1977 |

* cited by examiner

*Primary Examiner*—Robert J. Sandy
(74) *Attorney, Agent, or Firm*—Everest Intellectual Property Law Group; Michael S. Leonard

(57) ABSTRACT

A buckle (10) including a plug (30) and a socket (20) is provided with a posture-adjuster that adjusts relative postures of the plug (30) and the socket (20) in a direction that leads a longitudinal axis ($A_2$) of the plug (30) and a longitudinal axis ($A_1$) of the socket (20) to be parallel when the plug (30) is relatively moved in a direction toward inside of the socket (20) from an insertion slot (21) thereof. The posture-adjuster has a guide path (24) that is provided to the socket (20) and has a width that becomes wider as being closer to the front end side thereof as well as a step portion (36) as a guided member that is provided to the plug (30) and guided by the guide path (24).

10 Claims, 12 Drawing Sheets

BUCKLE

BACKGROUND OF THE INVENTION

1. Field of the Invention

The present invention relates to a buckle including a socket and a plug that can be manually attached to and detached from each other and more particularly to a buckle for coupling each end of a tape-shaped member such as a belt together and separating the ends from each other.

2. Description of Related Art

Conventionally, a buckle has been used for coupling each end of a tape-shaped member such as a belt together and separating the ends from each other (document 1: Japanese Patent Laid-Open publication No. 2003-284606; document 2: U.S. Pat. No. 5,926,928).

The buckle includes a socket having an opening in a front end side and a plug that can be detachably engaged with the socket when being inserted in the socket.

When inserting the plug into the socket, a longitudinal axis of the socket and a longitudinal axis of the plug are aligned in parallel and then the plug is inserted straight into the socket in the state. Thus, the plug is inserted in and engaged with the socket.

Note that, when an insertion slot is defined in a front end of a socket and a plug is inserted with a front end thereof first into the insertion slot of the socket, the longitudinal axis of the socket is an axis that passes the gravity center of the socket and extends from the insertion slot toward the inside of the socket, while the longitudinal axis of the plug is an axis that passes the gravity center of the plug and extends from a front end toward a back end of the plug.

In the conventional buckle, the longitudinal axes of the socket and the plug need to be aligned before the socket is inserted into the plug, requiring effort in adjusting relative postures of the socket and the plug.

In addition, if a user attempts to insert the plug into the socket without aligning the longitudinal axes of the socket and the plug beforehand, the plug may not be inserted into the socket or may be stuck halfway, causing a problem that the plug needs to be separated from the socket and reinserted to the plug after aligning the longitudinal axes of the socket and the plug.

When considering actual situations where the buckle is used, for instance, in a situation where the buckle is used for securely tightening a belt of a bag, a user tends to insert the plug into the socket fixed on the bag only with the plug in a hand (not both of the socket and plug). In this case, since the longitudinal axes of the socket and the plug cannot be easily aligned, the user may be imposed to try to reinsert the plug many times, deteriorating the usability.

SUMMARY OF THE INVENTION

An object of the present invention is to provide a buckle in which a socket and a plug can be easily and smoothly engaged to each other.

A buckle of the present invention includes a plug, a socket into which the plug is inserted, an engaging unit that detachably engages the plug and the socket, and a posture-adjuster that adjusts relative postures of the plug and the socket when the plug is relatively moved toward the socket.

In this arrangement, when the plug is inserted into the socket, the plug is engaged in the socket by the engaging unit.

And when the plug is relatively moved along an insertion direction toward inside of the socket, the relative postures of the plug and the socket are adjusted by the posture-adjuster. Thus, an axis of the plug and an axis of the socket are aligned parallel due to the adjustment by the posture-adjuster, so that the plug can be smoothly inserted into the socket from the parallel state.

By employing this arrangement, even when the axes are not parallel but intersecting (twisted) and the plug is inserted into the socket from this state by being relatively moved along each axis, the axes of the socket and the plug are adjusted to be parallel by the posture-adjuster. In this state in which the axes of the socket and the plug have come parallel, lightly pushing the socket and the plug in a direction along each axis will smoothly insert the plug into the socket.

As described above, even if the relative postures of the plug and the socket have not initially been adjusted when inserting the plug into the socket, both axes are adjusted parallel by the posture-adjuster, saving effort in checking and adjusting the relative postures of the socket and the plug and achieving easy engagement between the socket and the plug. Additionally, since the relative postures of the socket and the plug are adjusted by the posture-adjuster as the plug is being further inserted into the socket, the plug will not get stuck during the insertion and the plug can be inserted in the socket by one handling without fail.

According to the present invention, the posture-adjuster preferably includes: a guide path being provided to one of the plug and the socket and having a widening width; and a guided member that is provided to the other one of the plug and the socket and guided along the guide path.

Next, with this arrangement, the plug is inserted into the socket. Since one of the plug and the socket is provided with the guide path that becomes wider toward the end thereof, the guided member provided on the other one of the plug and the socket will go into the guide path. And, as the plug is being inserted into the socket, the guided member will be guided by the guide path.

In other words, since the guided member is provided on the other one of the plug and the socket, the other one of the plug and the socket will be guided as a result of that the guided member is guided by the guide path. Subsequently, the relative postures of the plug and the socket are adjusted such that the axis of the one of the plug and the socket which has the guided member becomes parallel to the axis of the other one during a process in which a moving direction is adjusted by the guide.

Specifically, by employing this arrangement, since the guide path employs widening shape, the guided member will go along the guide path even if the relative postures of the plug and the socket are not adjusted before inserting the plug into the socket. Accordingly, effort in adjusting the postures of the plug and the socket beforehand is not required, achieving easy handling of the buckle.

If both of the socket and the plug are flat, or if the socket and the plug cannot be engaged to each other without adjusting the positions of the engaging units beforehand, the guide path and the guided member need to be provided at a predetermined position such that the guide path and the guided member abut on each other when the plug is inserted into the socket.

And, if tops and bottoms (front and rear surfaces) of the plug and the socket need to be adjust before inserting the plug into the socket, the guide path and the guided member need to be provided on the same surface (top or bottom) of the socket and the plug.

According to the present invention, the posture-adjuster preferably has an axis path that is continuously formed from the guide path in the one of the plug and the socket.

In this arrangement, when the plug is further inserted into the socket, the guided member is guided by the guide path and then by the axis path. Accordingly, since the axis path is defined, the moving direction of the guided member is regulated by the direction of the axis path.

In addition to that the relative postures of the plug and the socket have been adjusted and the axes have been aligned by the guide of the guide path, the relative movement directions of the plug and the socket become the same as the direction of the axis path, so that the plug can be smoothly inserted into the socket.

According to the present invention, the guided member preferably has a predetermined length.

In this arrangement, the front end of the guided member is guided by the guide path as the plug is being inserted into the socket, so that the relative postures of the plug and the socket are adjusted and the axes are aligned.

In addition, since the guided member has the predetermined length, when the guided member of the predetermined length passes top points on the side opposite to the widening side of the guide path, the relative movement directions of the plug and the socket are led to be the longitudinal direction of the guided member. Consequently, the plug can be smoothly inserted into the socket.

According to the present invention, the guide path is preferably provided to the socket, the socket preferably includes a top plate and a bottom plate forming top and bottom surfaces, and the guide path is preferably provided to at least one of the top plate and the bottom plate.

In this arrangement, if at least one of the top plate and the bottom plate of the socket is provided with the guide path, the guided member of the plug to be inserted into the socket can be guided.

Note that, guide paths having the same shape may be defined in both of the top plate and the bottom plate. And if the guide paths having the same shape are defined in both of the top plate and the bottom plate, it is preferable that such guide paths are provided on both of top and bottom sides of the guided member of the plug.

By employing this arrangement, the socket and the plug can be used without checking their tops and bottoms, so that checking the tops and bottoms of the socket and the plug is not required, thereby enabling easy handling of them.

According to the present invention, preferably, the guide path is provided to the socket and formed by guide peripheral portions provided on peripheral side surfaces of peripheral walls that are formed by cutting off the peripheral walls of the socket; and the guided member includes a guide bar that is provided to the plug and can be inserted into the socket, and a step portion that protrudes from the guide bar such that the step portion can abut on the guide peripheral portions when the guide bar is inserted in the socket.

In this arrangement, the step portion protruding from the guide bar abuts on the guide peripheral portion forming the guide path when the plug is inserted into the socket. If the plug is further inserted into the socket, the step portion is guided while abutting on the guide peripheral portion, and the relative postures of the plug and the socket are adjusted such that the axes of the plug and the socket become parallel. In this state in which the axes of the socket and the plug have come parallel, lightly pushing the socket and the plug in the direction along each axis will smoothly insert the plug into the socket.

By employing this arrangement, the guide path is formed by cutting off the peripheral walls of the socket, that is, since portion occupied by the guide path in a conventional socket is removed from the socket, thereby reducing weight and material cost of the socket.

The guide peripheral portion may be the peripheral side surface itself of the peripheral wall which is defined by cutting off the peripheral wall of the socket, or may be a wall surface defined by folding the peripheral side surface of the peripheral wall to form a guide peripheral side surface having a predetermined height.

Note that, if the axis path is provided to the socket, it is preferable to form this axis path by cutting off the peripheral wall.

In addition, the guide path may be provided to the guide bar and the guided member may be provided to the socket. Specifically, the front end of the guide bar may bifurcate and each of the bifurcated portions may form the axis path. And, the protruding portion that is engaged to the axis path of the guide bar may protrude from the inner wall of the socket.

According to the present invention, the step portion preferably has a through hole penetrating the step portion and the guide bar is defined to form a peripheral portion of the step portion.

In this arrangement, when the plug is inserted into the socket, the peripheral portion of the step portion abuts on the guide peripheral side surface and is guided, so that the relative postures of the plug and the socket are adjusted such that the axes of the plug and the socket become parallel.

Since the step portion needs to abut on the guide peripheral side surface only with the outer circumference thereof, the step portion can be hollow in the middle portion and a through hole that penetrates the middle portion of the step portion and the guide bar may be defined. By providing such through hole, the weight and material cost of the plug can be reduced.

According to the present invention, the engaging units extend from the back end side toward the front end on the both sides of the plug and have a flexible pair of lock arms that can be inserted into the socket and detachably engage to the socket. The front end of the step portion is preferably positioned on a line connecting the front ends of the pair of lock arms or forward position of the line.

In this arrangement, when the plug is inserted in the socket, the pair of lock arms provided to the plug engage with the socket.

And, the step portion is provided to the guide bar of the plug and the front end of the step portion is positioned on the line connecting the front ends of the pair of lock arms or forward position of the line.

Accordingly, when the plug is inserted into the socket, the step portion abuts on the guide peripheral side surface to be guided before the front end of the lock arm abuts on the socket.

In other words, even if the axes of the plug and the socket have not been aligned before the plug is inserted into the socket, the step portion is guided by the axis path prior to the lock arm, so that the relative postures of the plug and the socket have been adjusted by the time when the lock arm goes into the socket. Consequently, troubles (for instance, the lock arm gets stuck in the socket) can be avoided, so that the plug can be smoothly inserted into the socket.

It should be noted that, if the front end of the step portion can abut on the guide path before the front end of the lock arm abuts thereon, the front end of the step portion does not always need to be on the line connecting the front ends of the lock arms or forward the line.

According to the present invention, the socket preferably includes the top plate and bottom plate forming the top and bottom surfaces, and the guide bar preferably includes held portions that are held between the top plate and the bottom plate when the guide bar is being inserted in the socket.

In this arrangement, the held portion of the guide bar is held between the top plate and the bottom plate of the socket when the plug is inserted in the socket, so that the posture of the plug can be stable in the socket when the plug is being inserted in the socket.

According to the present invention, the guide bar preferably includes a pair of bridges and the pair of bridges are preferably connected by a connecting portion to each other.

By employing this arrangement, even if the guide bar is formed by the pair of bridges, since the connecting portion connects the pair of bridges to each other, flexure of the bridges can be prevented and rigidity thereof can be enhanced. Further, by enhancing the rigidity of the bridges, guiding operation of the bridges as a guide bar can be more reliable, thereby securely providing the expected guide function.

DETAILED DESCRIPTION OF PREFERRED EMBODIMENT(S)

Figure 1:
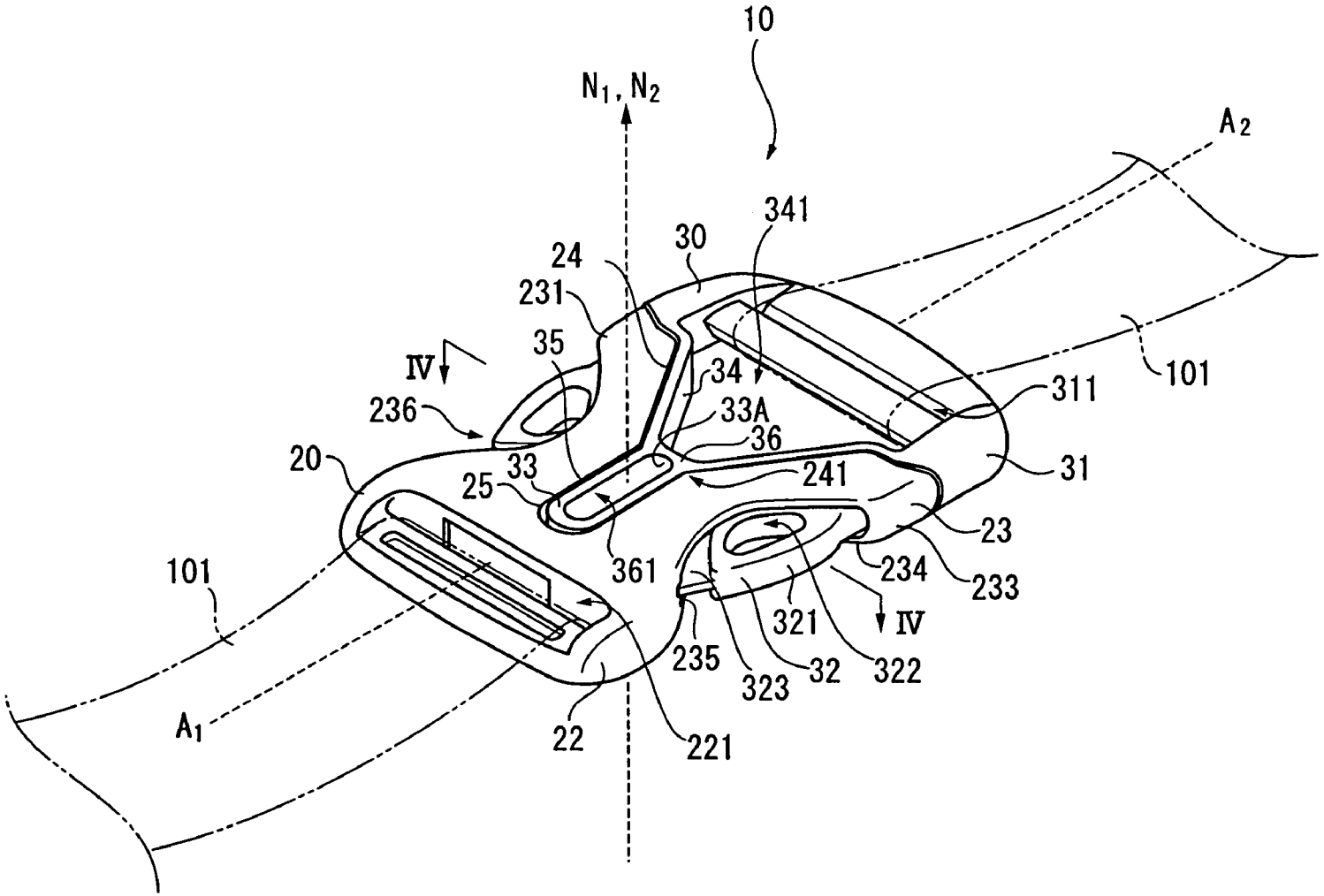
FIG. 1 is a perspective view showing a state in which a plug and a socket of a buckle are engaged to each other according to a first embodiment of the present invention.

Embodiments of the present invention will be illustrated and described in reference to the reference numeral denoted to each component in the drawings.

First Embodiment

A first embodiment of a buckle of the present invention will be described in reference to FIGS. 1 to 7.

Figure 2:
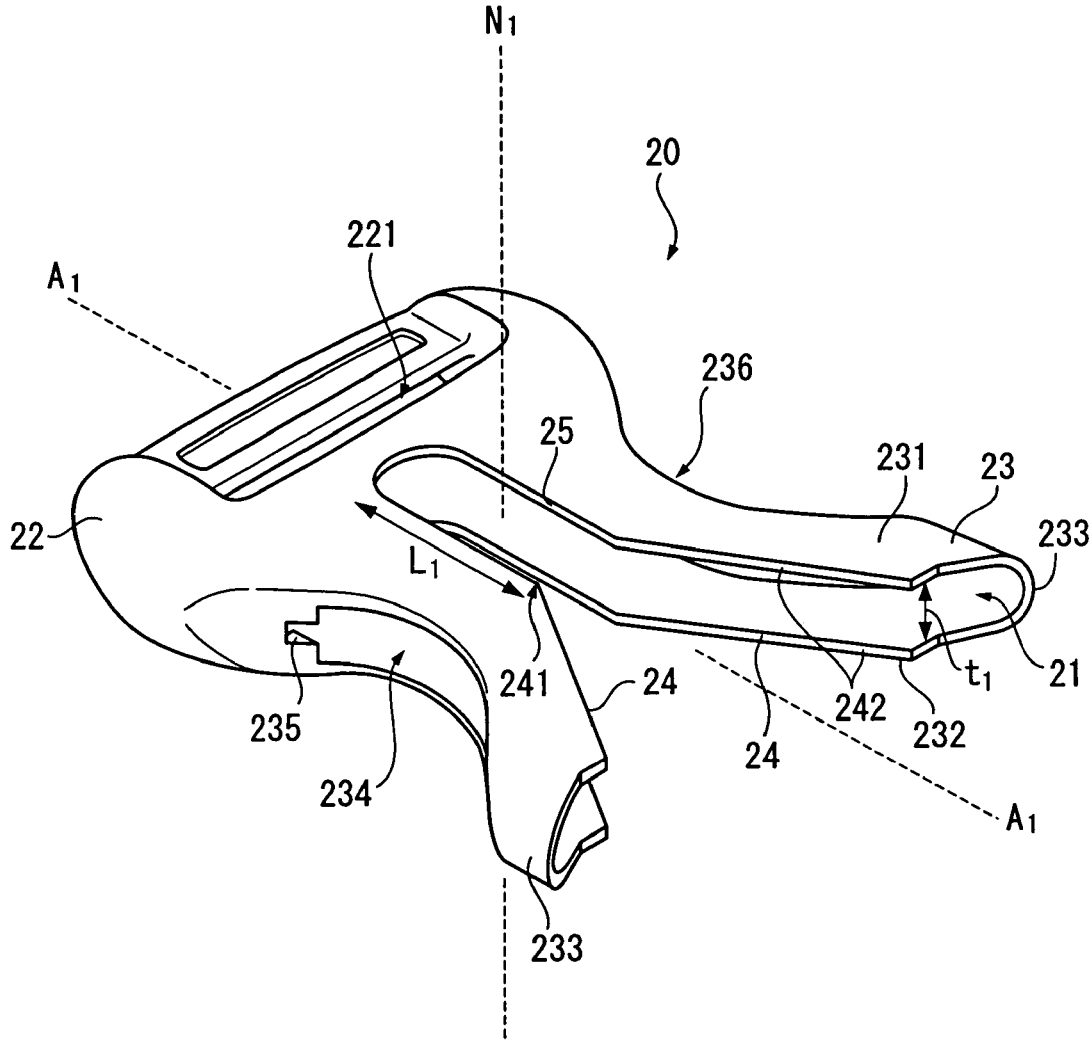
FIG. 2 is a perspective view showing a structure of the socket according to the first embodiment.
Figure 3:
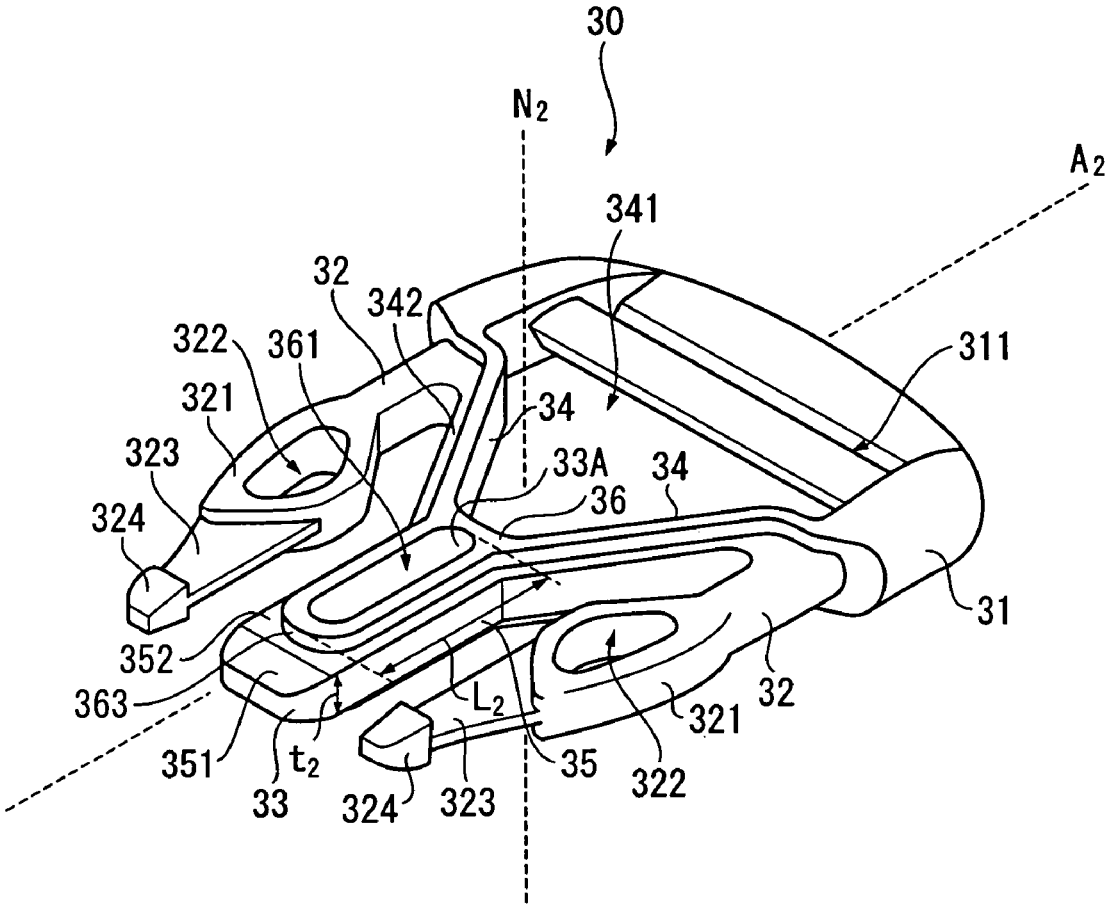
FIG. 3 is a perspective view showing a structure of the plug according to the first embodiment.
Figure 4:
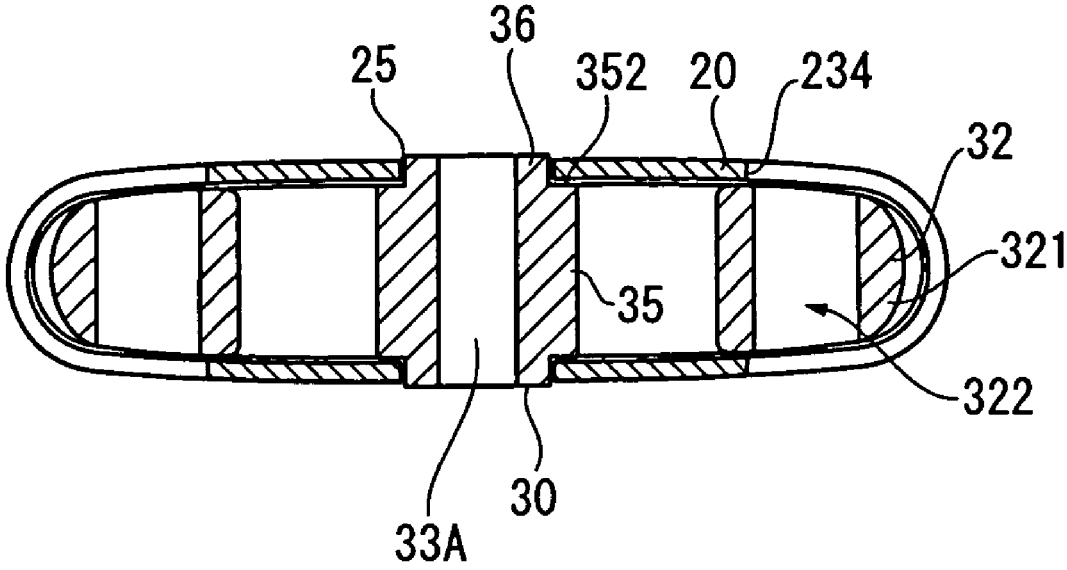
FIG. 4 is a cross section taken along IV-IV line in FIG. 1 according to the first embodiment.

FIG. 1 is a perspective view showing a state in which a plug is inserted in a socket. FIG. 2 is a perspective view showing the socket, while FIG. 3 is a perspective view showing the plug.

As shown in FIG. 1, the buckle is for coupling a belt attached to the socket and a belt attached to the plug to each other and for separating the belts from each other, and is a side-release buckle in which engagement of the socket and the plug can be released by pressing the sides of the socket.

The buckle 10 includes the socket 20 and the plug 30.

As shown in FIG. 2, the socket 20 is a tube member having in a front end an insertion slot 21 into which a front end side of the plug 30 is inserted, and includes a socket base 22 to which a belt 101 is attached as well as a housing 23 having a flat and tubular shape and constituted of a top plate 231 and a bottom plate 232, which respectively form a top surface and a bottom surface, and a pair of side plates 233 forming side surfaces.

The socket base 22 forms a back end side of the socket 20 and has a belt-fastening slit 221 through which the belt 101 is threaded to be fixed.

The housing 23 has a narrow portion 236 defined by being semicircularly cut off the both sides, and the side plates 233 have an operation opening 234 connecting to the interior of the housing 23. The side plates 233 also has a locking opening 235 that connects to a back-end-side peripheral edge of the operation openings 234 and has a shorter opening width in a vertical axis $N_1$ direction than the operation openings 234.

The top plate 231 and the bottom plate 232 of the housing 23 have guide paths 24 defined by being cut off in a substantially triangular shape from the front end side toward the back end side and axis paths 25 defined by being cut further toward the back end side from top points 241 of the back end side of the guide paths 24.

The guilds 24 become wider as being closer from the top points 241 to the front end. Specifically, a guide direction of the guide paths 24 is determined by guide peripheral plate portions 242 (guide peripheral portions) continuously from the insertion slot 21. The width of the guide paths 24 at the front end side is approximately two thirds of the width of the insertion slot of the socket 20. And an angle between the guide path 24 and the longitudinal axis $A_1$ as a centerline is approximately 30 degrees (indicated as a in FIG. 5).

The axis path 25 is defined with a predetermined length $L_1$ along the longitudinal axis $A_1$.

The guide paths 24 and the axis paths 25 are opened so as to link the interior and exterior of the socket 20.

As shown in FIG. 3, the plug 30 has a plug base 31 to which the belt 101 is attached, a pair of lock arms 32, 32 protruding toward the front end side on both side ends of the plug base 31 and a guide bar 33 provided between the lock arms 32, 32 and having a predetermined length along the longitudinal axis $A_2$.

The plug base 31 forms a back end side of the plug 30 and has a belt-fastening slit 311 through which the belt 101 is threaded to be fixed.

The pair of lock arms 32, 32 and the guide bar 33 can be inserted in the socket 20, forming the front end side of the plug 30.

The lock arm 32 is a flexible arm and has a pressing portion 321 that is formed in the middle of the lock arm 32 and for pressing the lock arm 32 from the side to the inner side thereof, a thin-plate connecting portion 323 being a thin plate and extending from the pressing portion 321 toward the front side and a locking claw 324 provided at the front end of the lock arm 32 so as to form a protruding step relative to the thin-plate connecting portion 323.

The pressing portion 321 has a shape in which an outer side surface slightly laterally expands in an arch shape relative to an outer line of the lock arm 32. The locking claw 324 is tapered and chamfered as being closer to the frond end.

When the plug 30 is inserted in the socket 20, the pressing portion 321 is exposed from the operation opening 234 of the socket 20 (see FIG. 1), the thin-plate connecting portion 323 fits in the locking opening 235, and the locking claw 324 engages with the locking opening 235. Note that, the pressing portion 321 has a through hole 322 defined in the middle thereof.

The guide bar 33 has a pair of bridges 34, 34 extending from the both side ends of the plug base 31 toward the front side so as to approach and contact to each other on the longitudinal axis $A_2$, a guide head 35 further extending from the front end of the bridges 34, 34 toward the front side along the longitudinal axis $A_2$ and having a predetermined length and a step portion 36 formed in a convex shape with steps protruding from the upper and bottom surfaces of the guide head 35 and the bridge 34.

The pair of bridges 34, 34 forms a substantially triangle shape with a through hole 341 in the middle thereof. The back end side (plug base 31 side) of the guide head 35 forms a connecting portion 33A that couples the front end sides of the pair of bridges 34, 34.

The guide head 35 has a substantially same thickness ($t_2$) as a distance ($t_1$) between the top plate 231 and the bottom plate 232 of the housing 23. The front end of the guide head 35 is on a line connecting the frond ends of the pair of lock arms 32, 32.

The front end of the guide head 35 is tapered, forming a tapered surface 351 in which the thickness thereof becomes thinner as being closer to the frond side.

The step portion 36 is formed on the guide head 35 and the bridge 34 in a convex shape in which the step portion 36 protrudes from the upper and bottom surfaces of the guide head 35 and the bridge 34 as described above, and has a thickness substantially same as the distance between the top plate 231 and the bottom plate 232 of the housing 23. The front end of the step portion 36 is chamfered and has an arch shape.

The step portion 36 of the guide head 35 is formed a little smaller than the guide head 35, so that a surface 352 of the guide head 35 is next to the front surface and side surface of the step portion 36 and a surface 342 of the bridge 34 is next to the side surface of the step portion 36 of the bridge 34. When the guide bar 33 is inserted in the socket 20, the guide bar 33 is held on the other surfaces than the step portion 36 (i.e. on the surfaces 342, 352) by the top plate 231 and the bottom plate 232 of the housing 23, forming a held portion (see FIG. 4).

The step portion 36 of the guide head 35 has a through hole 361 defined in the middle thereof and a peripheral portion 363 around the through hole 361. The through hole 361 penetrates the step portion 36 and the guide head 35.

The step portion 36 of the guide head 35 has a shape with a predetermined length of $L_2$ ($L_1$=$L_2$) along the longitudinal axis $A_2$ corresponding to the axis path 25 of the socket 20, while the step portion 36 of the bridge 34 has a shape corresponding to the guide path 24 of the socket 20.

The operation opening 234 and the locking opening 235 of the socket 20 and the lock arm 32 of the plug 30 constitute an engaging unit for detachably engaging the plug 30 and the socket 20 when the plug 30 is inserted in the socket 20.

The guide bar 33 constitutes a guided member that abuts on the guide path 24 to be guided thereby, and the guide path 24 and the axis path 25 of the socket 20 as well as the guide bar 33 and the step portion 36 of the plug 30 constitute a posture-adjuster for adjusting relative postures of the plug 30 and the socket 20 into a direction to align the longitudinal axis $A_2$ of the plug 30 and the longitudinal axis $A_1$ of the socket 20 in parallel when the plug 30 is moved into the inside of the socket 20 from the insertion slot 21 along an insertion direction.

Movements and functions of the buckle of the first embodiment having the above-described arrangement will be described in reference to FIGS. 5 to 7.

To insert the plug 30 into the socket 20, firstly, the front end of the plug 30 is positioned at the insertion slot 21 of the socket 20.

Figure 5:
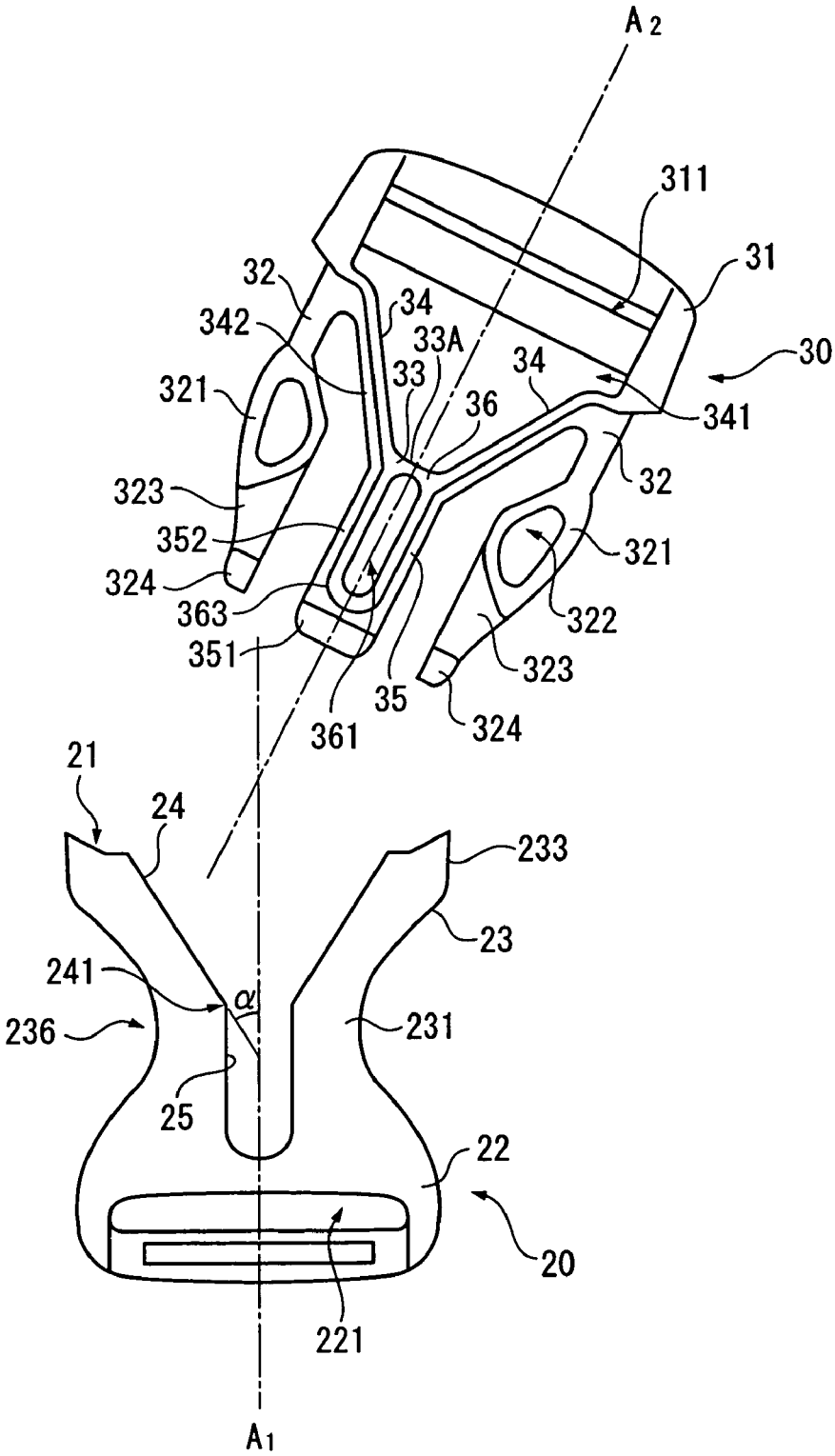
FIG. 5 is an illustration showing postural change of the plug when being inserted into the socket according to the first embodiment.

Specifically, according to the first embodiment, the front end of the plug 30 needs to be roughly facing the insertion slot 21 of the socket 20, and the longitudinal axis $A_2$ of the plug 30 and the longitudinal axis $A_1$ of the socket 20 may not be parallel but may be intersecting (see FIG. 5).

From this state, the plug 30 is moved along the longitudinal axis $A_2$ toward the insertion slot 21 of the socket 20.

Figure 6:
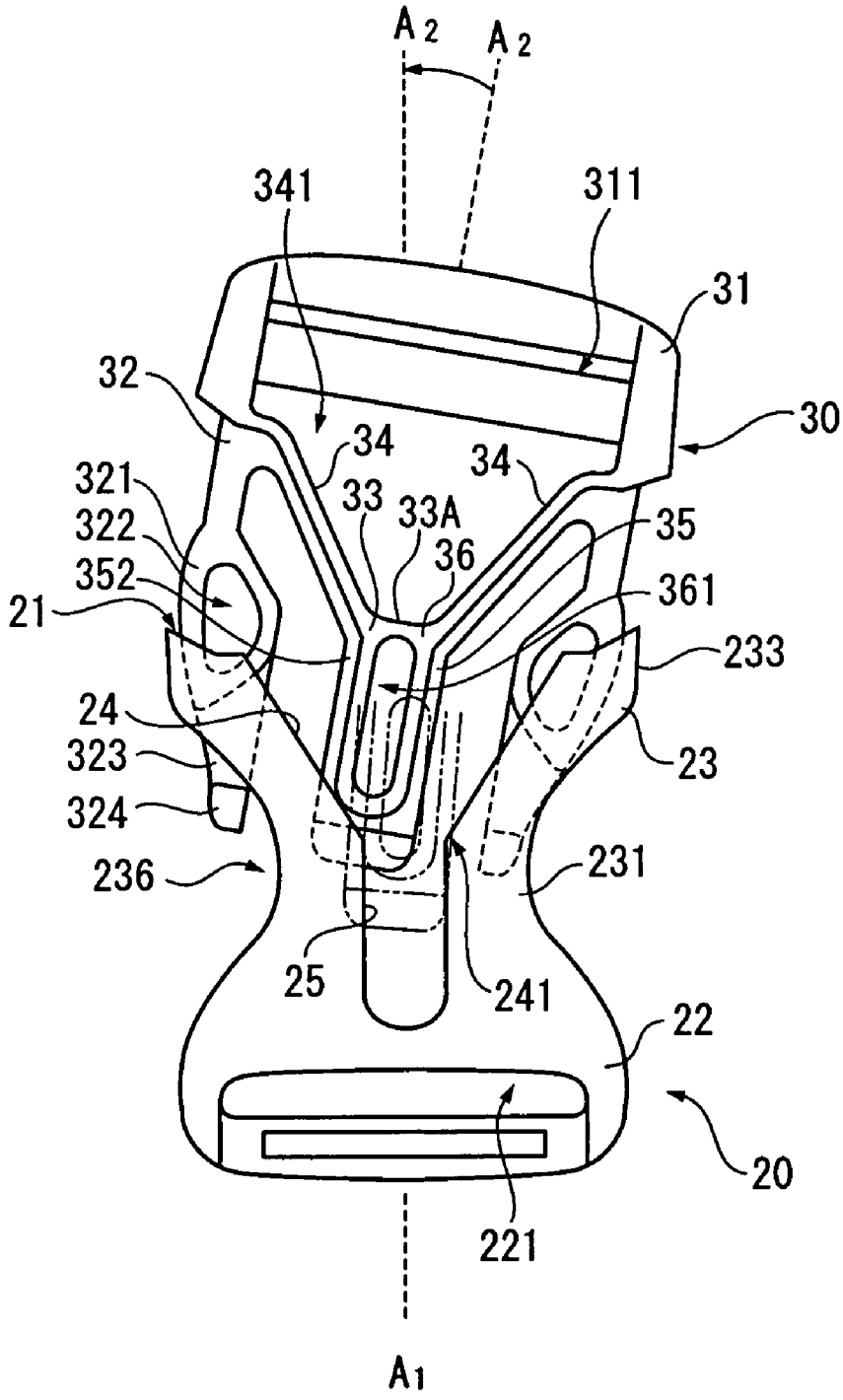
FIG. 6 is another illustration showing the postural change of the plug when being inserted into the socket according to the first embodiment.

Then, the front end of the plug 30 is gradually inserted into the insertion slot 21 of the socket 20 until the front end of the step portion 36 abuts on the guide path 24 (see FIG. 6).

After the front end of the step portion 36 abuts on the guide path 24, as the plug 30 is further inserted into the socket 20, the frond end of the step portion 36 is guided toward the top point 241 of the guide path 24 while the posture of the plug 30 is adjusted in a direction that leads the longitudinal axis $A_2$ of the plug 30 to be parallel to the longitudinal axis $A_1$ of the socket 20.

Figure 7:
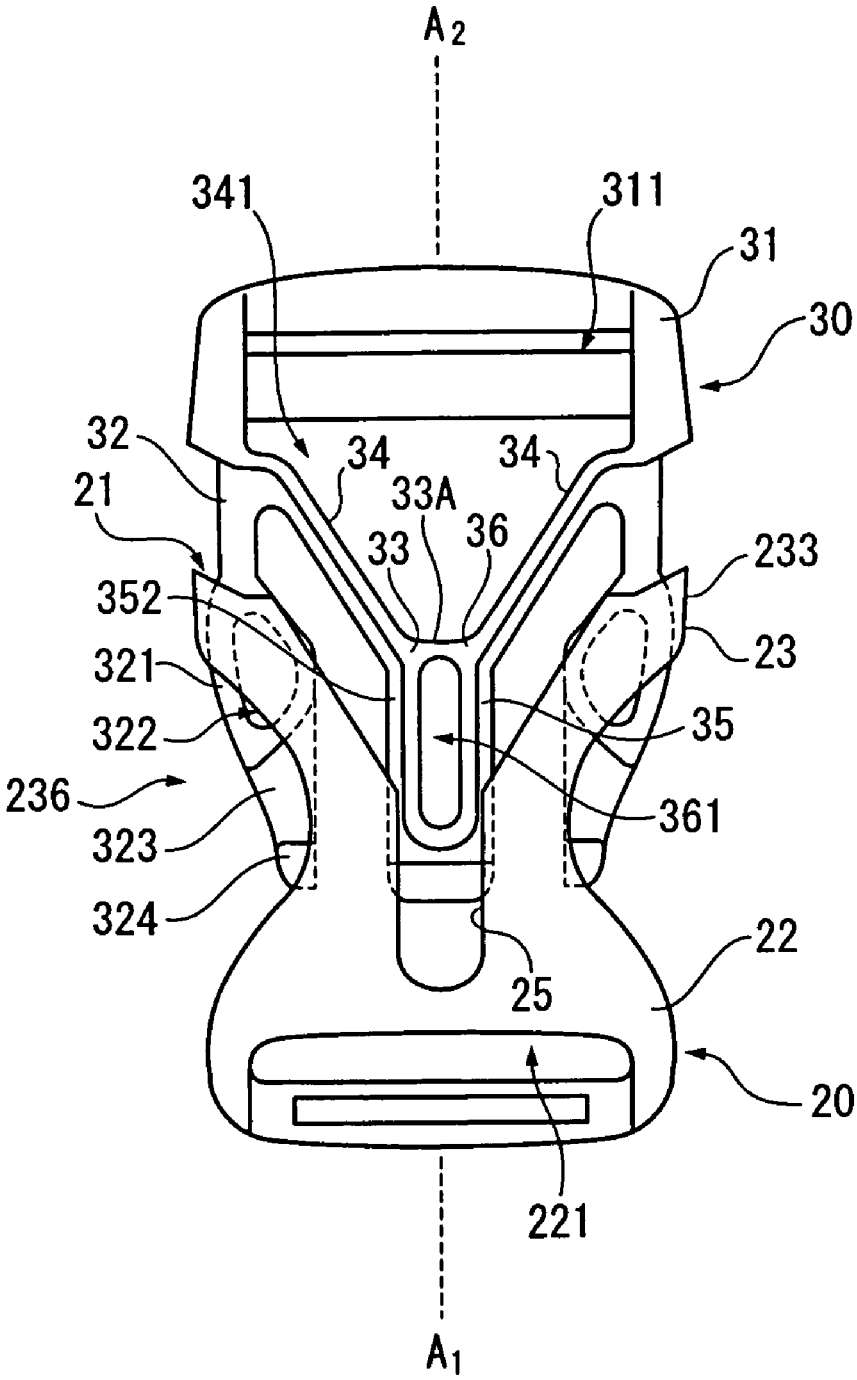
FIG. 7 is still another illustration showing the postural change of the plug when being inserted into the socket according to the first embodiment.

When the front end of the step portion 36 contacts with the top point 241 of the guide path 24, the longitudinal axis $A_2$ of the plug 30 and the longitudinal axis $A_1$ of the socket 20 become parallel as shown in FIG. 7, and if the plug 30 is further pushed into the socket 20 from this state, the front end of the step portion 36 will move along the axis path 25.

When the front end of the step portion 36 reaches the back end of the axis path 25, the step portion 36 of the guide head 35 abuts on the peripheral side surface of the axis path 25, closing the opening of the axis path 25. The step portion 36 of the bridge 34 abuts on the peripheral side surface of the guide path 24, closing the opening of the guide path 24. Inside the socket 20, the locking claw 324 of the lock arm 32 is engaging with the locking opening 235 of the socket 20. Thus, as shown in FIG. 1, the plug 30 and the socket 20 are engaged to each other with the plug 30 being fitted in the socket 20.

When releasing the engagement of the plug 30 and the socket 20, the engagement between the locking opening 235 and the locking claw 324 is firstly released by pressing the pressing portion 321 of the lock arm 32 on the sides toward the inside, then the plug 30 can be disconnected from the socket.

According to the first embodiment having the above-described arrangement, following effects can be obtained.

(1) Since the socket is provided with the guide path 24 and the plug 30 is provided with the step portion 36 (the guided member that abuts on the guide path 24 to be guided), when the plug 30 is inserted into the socket 20, even if the longitudinal axes $A_1$ and $A_2$ are not in parallel but intersecting (twisted) and the plug 30 is inserted into the socket 20 by moving them relatively along the longitudinal axes $A_1$, $A_2$, the longitudinal axis $A_1$ and the longitudinal axis $A_2$ of the socket 20 and the plug 30 can be adjusted to be parallel (see FIG. 6).

Therefore, even if the relative postures of the plug 30 and the socket 20 have not initially been aligned before inserting the plug 30 into the socket 20, the longitudinal axes $A_1$ and $A_2$ are adjusted to be parallel, saving effort in checking and adjusting the relative postures of the socket 20 and the plug 30 as well as achieving easy engagement between the socket 20 and the plug 30. Additionally, since the guide path 24 guides the front end of the step portion 36 in order to adjust the posture of the plug 30 as the plug 30 is being further inserted into the socket 20, the plug 30 will not be stuck halfway and the plug 30 can be inserted in the socket 20 by one handling without fail.

(2) Since the width of the guide path 24 becomes larger as being closer to the front end side, when inserting the plug 30 into the socket 20, only by inserting the front end of the plug 30 to the insertion slot 21 of the socket 20, the step portion 36 will go along the guide path 24, so that the relative postures of the plug 30 and the socket 20 do not need to be adjusted beforehand. Accordingly, effort of adjusting the postures of the plug 30 and the socket 20 beforehand is not required, achieving easy handling of the buckle 10.

(3) The axis path 25 is provided along the longitudinal axis $A_1$ of the socket 20, as described above. Hence, after the front end of the step portion 36 is guided by the guide path 24, the step portion 36 will be guided by the axis path 25. And since the step portion 36 provided on the guide head 35 has the predetermined length $L_2$ along the longitudinal axis $A_2$, the longitudinal axes $A_1$, $A_2$ which are longitudinal directions of the step portion 36 and the axis path 25 will naturally become parallel, when the step portion 36 passes the top point 241 of the guide path 24. The longitudinal axes $A_1$, $A_2$ are thus adjusted in directions to be parallel, so that relative moving directions of the plug 30 and the socket 20 become along the longitudinal axes $A_1$, $A_2$, thereby enabling smooth insertion of the plug 30 into the socket 20.

(4) The guide path 24 and the axis path 25 are formed by cutting off the top plate 231 and the bottom plate 232. In other words, the socket 20 is formed by removing portion occupied by the guide path 24 and the axis path 25 from a conventional socket, thereby reducing weight and material cost of the socket. The guide path 24 and the axis path 25 are also formed by cutting off the top plate 231 and the bottom plate 232 such that the inside and outside of the socket 20 are linked. Accordingly, a peripheral wall of the socket can be thinner as compared with a socket in which a groove for guiding is formed in an inner wall surface thereof, thereby further reducing the weight and material cost of the socket.

(5) Since the through hole 361 is defined in the middle of the step portion 36 of the guide head 35 and an open space enclosed by the pair of bridges forms the through hole 341, the weight and material cost of the plug 30 can be reduced. In addition, the pressing portion 321 has the through hole 322, thereby further reducing the weight and material cost of the plug 30.

(6) The through hole 361 that is defined in the step portion 36 of the guide head 35 and the through hole 341 that is defined by the open space enclosed by the pair of bridges 34 are fit with the guide path 24 and the axis path 25 formed by cutting off the peripheral wall (the top plate 231 and the bottom plate 232) of the socket 20 when the plug 30 is inserted in the socket 20, so that the through hole 361 and the through hole 341 will not be closed but kept open to the outside even when the plug 30 is in the socket 20. Accordingly, air can flow through the space between the top and bottom surfaces of the buckle 10 even when the plug 30 is inserted in the socket 20. Therefore, for example, when a piece of fabric such as a belt is attached to a rear surface of the buckle, ventilation can be kept good, thereby preventing mold from generating.

(7) The step portion 36 is formed a little smaller than the guide bar 33, and on the front and side surfaces of the step portion 36, the surface 352 of the guide bar 33 exists as the held portion. When the plug is inserted in the socket 20, since the held portion is held by the top plate 231 and the bottom plate 232 of the socket 20 (see FIG. 4), the plug 30 can be stable in the socket 20, thereby preventing the plug 30 from shaking in the socket 20. Further, the socket 20 and the plug 30 of the buckle 10 in engagement can withstand twisting and torsion force.

(8) Since the guide path 24 and the axis path 25 of the socket 20 and the step portion 36 of the plug 30 are provided on both of the top surface and the bottom surface, there is no distinction between top and bottom (front and rear) and it is not required to check the tops and bottoms of the socket 20 and the plug 30 when inserting the plug 30 into the socket 20, thereby facilitating the insertion.

(9) The front end of the guide bar 33 is provided with the tapered surface 351 in which the thickness becomes thinner as being closer to the front end, so that the front end of the guide bar 33 can be easily inserted between the top plate 231 and the bottom plate 232 of the socket 20. Accordingly, troubles in inserting the plug 30 into the socket 20 (for instance, the plug gets stuck in the socket 20) can be avoided when the plug 30 is inserted into the socket 20, thereby enabling smooth insertion of the plug 30 into the socket 20.

(10) The guide head 35 is divided into a pair of side portions by the through hole 361 and each side portion is continued to the bridge 34, so that the length thereof becomes longer and may be more flexible. But, in the embodiment, the back end portion of the guide head 35 connects as the connecting portion 33A the front end sides of the pair of brides 34, so that flexure of both sides of the bridges 34 and the guide head 35 can be regulated and rigidity thereof can be enhanced. Further, by enhancing the rigidity of the bridges 34 and the guide head 35, guide function of the guide bar 33, i.e. guiding operation shown in FIGS. 5 through 7 can be securely obtained.

(Variant 1)

A variant 1 of the buckle according to the present invention will be described in reference with FIG. 8.

Figure 8:
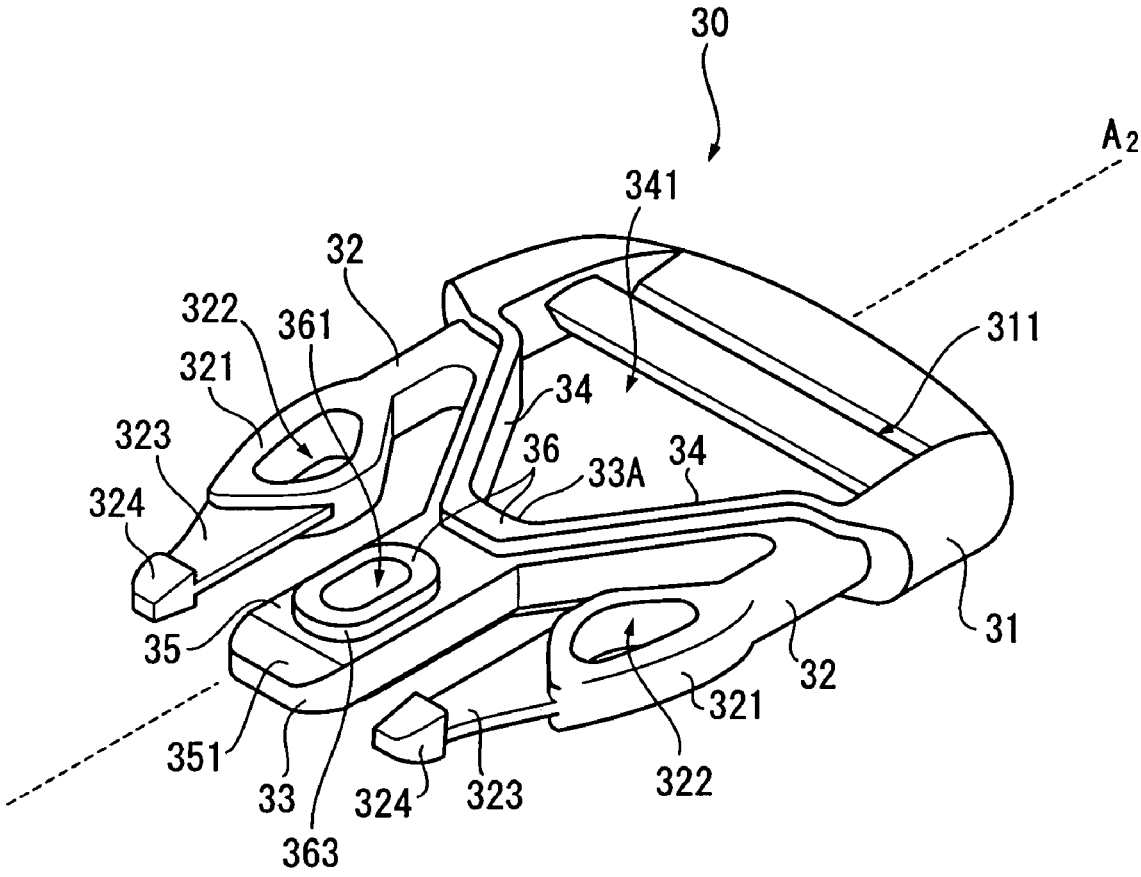
FIG. 8 is a perspective view showing a structure of a plug according to a variant 1 of the buckle of the present invention.

Although basic arrangement of the variant 1 is similar to the first embodiment of the present invention, the length $L_2$ of the step position 36 of the guide head 35 is shorter than that of the first embodiment (see FIG. 8). Specifically, the step portion 36 of the guide head 35 and the step portion 36 of the bridge 34 are provided separately.

In this arrangement, when the plug 30 is inserted into the socket 20, the front end of the step portion 36 is guided by the guide path 24 and the axis path 25 of the socket 20, and the relative postures of the plug 30 and the socket 20 are adjusted such that the longitudinal axes $A_1$, $A_2$ of the plug 30 and the socket 20 become parallel, thereby enabling smooth insertion of the plug 30 into the socket 20.

(Variant 2)

A variant 2 of the buckle according to the present invention will be described in reference with FIG. 9.

Figure 9:
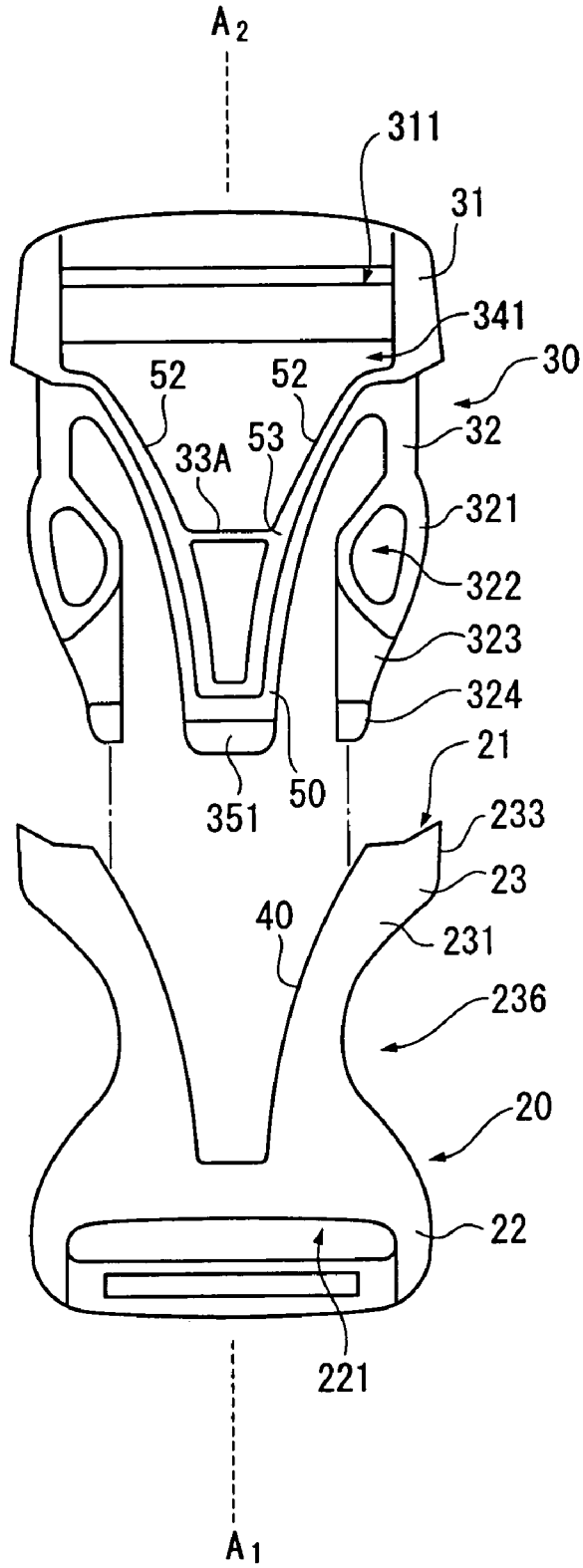
FIG. 9 is an illustration showing structures of a plug and a socket according to a variant 2 of the buckle of the present invention.

Although basic arrangement of the variant 2 is similar to the first embodiment of the present invention, the shape of the guide path of the socket 20 and the shapes of the guide bar and step portion of the plug 30 are different from those of the first embodiment (see FIG. 9).

Specifically, as shown in FIG. 9, the guide path 40 is cut off more deeply and in widening shape from vicinity of the back end toward the front end of the housing 23 as compared with the first embodiment. In other words, in the first embodiment, the linear axis path 25 is provided on the back end side of the top point 241 of the guide path 24, but in this variant, the axis path 25 is included in the guide path 40 that becomes wider as being closer to the front end.

On the other hand, the guide bar 50 of the plug 30 has a shape corresponding to the shape of the guide path 40 of the socket 20 and is provided such that the pair of bridges 52 contact with each other at each front end on the front end of the plug 30 (i.e. on a line connecting each front end of the lock arms).

In other words, in the first embodiment, the guide bar 33 has bridges 34 and the guide head 35 extended from the front ends of the bridges 34, but in the variant 2, the guide head is formed as a part of the bridge 52.

The step portion 53 is protruding from the upper and bottom surfaces and extending from the front end side of the guide bar 50 across the bridges 52 and, as a whole, has a shape corresponding to a substantially triangle formed by the pair of bridges 52, 52.

Note that, in the variant 2, the connecting portion 33A that connects the pair of bridges 52 at the middle thereof is provided to secure rigidity of each bridge 52.

In this arrangement, since the front end of the step portion 53 is guided by the guide path 40 when the plug 30 is inserted into the socket 20, the relative postures of the plug 30 and the socket 20 are adjusted such that the longitudinal axes $A_1$, $A_2$ of the plug 30 and the socket 20 become parallel, enabling smooth insertion of the plug 30 into the socket 20.

In particular, the guide path 40 has a longer, slower curve, so that the posture of the plug 30 is adjusted slowly and smoothly (not drastically), thereby enabling extremely smooth insertion of the plug 30 into the socket 20.

(Variant 3)

Figure 10:
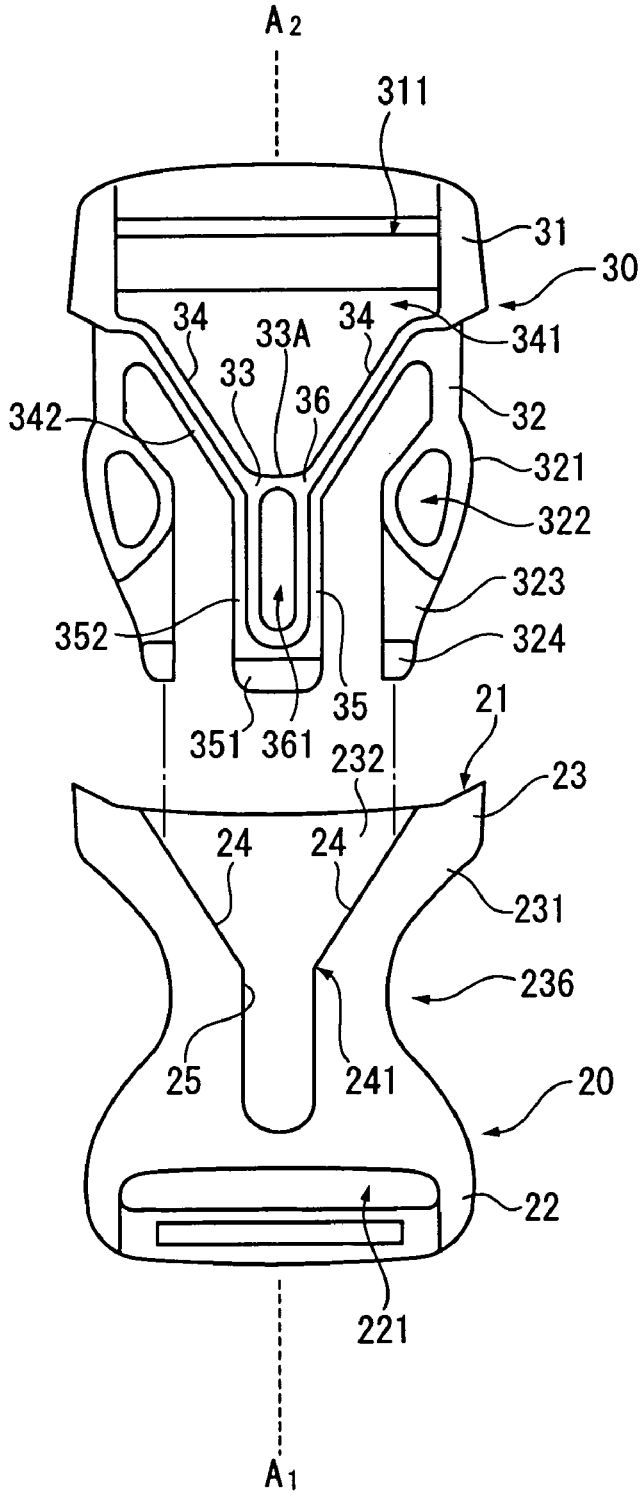
FIG. 10 is an illustration showing structures of a plug and a socket according to a variant 3 of the buckle of the present invention.

A variant 3 of the buckle according to the present invention will be described in reference with FIG. 10.

Although basic arrangement of the variant 3 is similar to the first embodiment of the present invention, the variant 3 has a feature that the guide path 24 and the axis path 25 of the socket 20 are provided only on the top plate 231, and the step portion 36 is provided only on the upper surface of the guide bar 33.

Since the guide path 24, axis path 25 and step portion 36 are thus provided on one of the upper and bottom surfaces (front and rear), the front end of the step portion 36 is guided by the guide path 24 and the axis path 25, and the relative postures of the plug 30 and the socket 20 are adjusted such that the longitudinal axes $A_1$, $A_2$ of the plug 30 and the socket 20 become parallel, enabling smooth insertion of the plug 30 into the socket 20.

Second Embodiment

A second embodiment of the buckle according to the present invention will be described in reference with FIG. 11.

Although basic arrangement of the second embodiment is similar to the first embodiment of the present invention, the second embodiment differs from the first embodiment in that the socket does not have an axis path.

Figure 11:
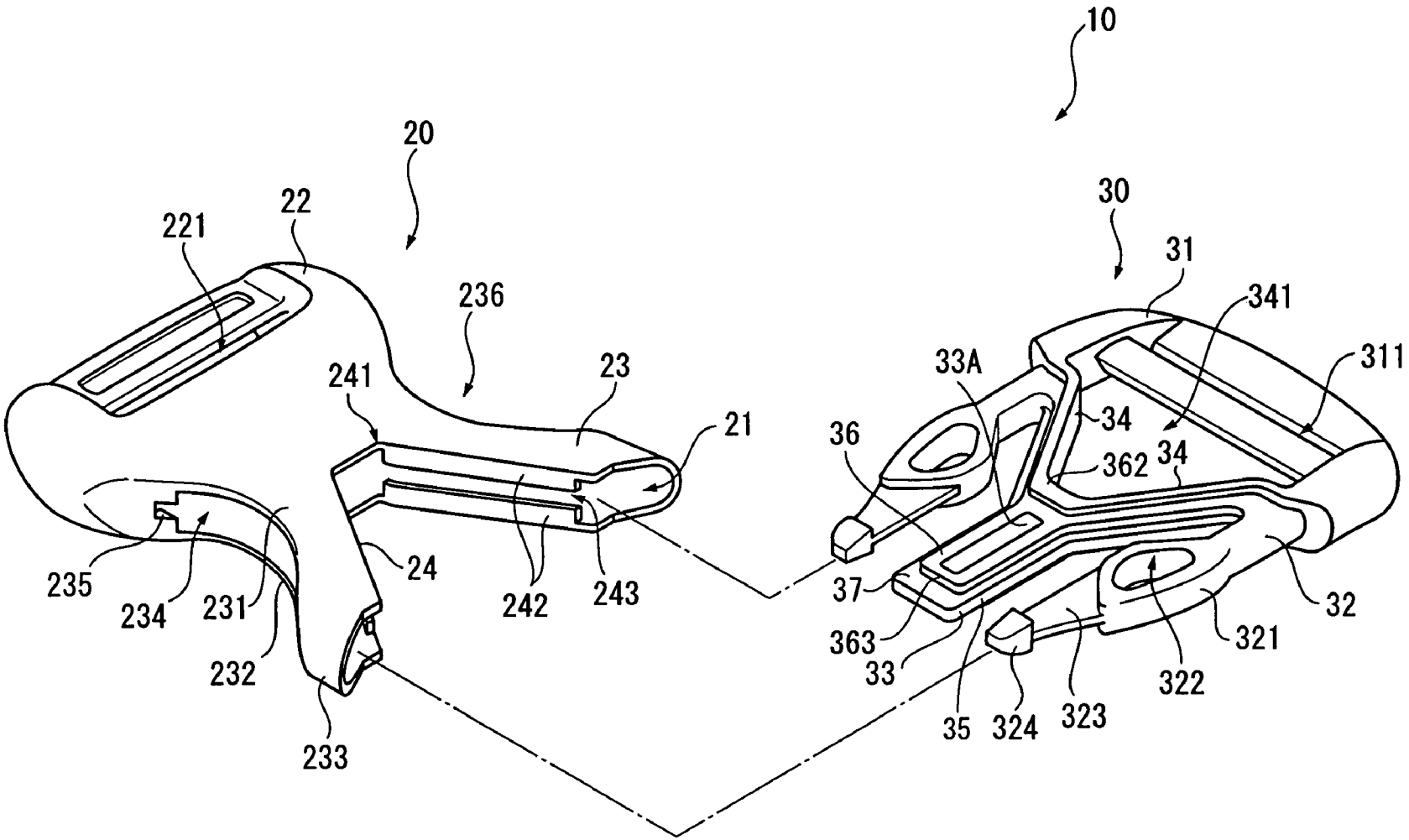
FIG. 11 is a perspective view showing structures of a plug and a socket according to a second embodiment of the buckle of the present invention.

As shown in FIG. 11, in addition to that the guide path 24 is defined by cutting off the top plate 231 and the bottom plate 232 of the socket 20, guide peripheral plate portions 242 are upstanding as the peripheral side surfaces of the top plate 231 and the bottom plate 232.

Between the guide peripheral plate portions 242, a space 243 through which a fringe 37 of the guide bar 33 can pass but the step portion 36 cannot pass is defined.

Note that, since the guide peripheral plate portions 242 are not provided on the top points 241 of the guide path 24, the step portion 36 can pass the top points 241 of the guide path 24 and be inserted between the top plate 231 and the bottom plate 232. And, the step portion 36 of the guide head 35 becomes the held portion held by the top plate 231 and the bottom plate 232 when the plug 30 is inserted in the socket 20.

The guide bar 33 is similar to the first embodiment in having the pair of bridges 34, 34 and the guide head 35 extended from the front end of the bridge 34, but the guide head 35 is thinner and the step portion 36 of the guide head 35 has a thickness that cannot pass through the space 243 of the guide peripheral plate portion 242 but can pass between the top plate 231 and the bottom plate 232.

On the other hand, the bridge 34 is provided with a step portion 362 of which height is larger than the step portion 36 of the guide head 35, so that the step portion 362 cannot pass between the top plate 231 and the bottom plate 232.

In this arrangement, in order to insert the plug 30 into the socket 20, the front end of the plug 30 is inserted into the socket 20 from the front end thereof. Specifically, the front end of the lock arm 32 is inserted into the insertion slot 21 between the guide peripheral plate portion 242 and the side plate 233, the fringe 37 of the guide head 35 is inserted into the space 243 between the guide peripheral plate portions 242, and the step portion 36 of the guide head 35 is pushed to be abut against the guide peripheral plate portions 242.

When the plug 30 is further pushed from this state, the front end of the step portion 36 is guided by the guide peripheral plate portions 242 until the front end of the step portion 36 reaches the top points 241 of the guide path 24, and the guide head 35 including the step portion 36 goes into a space between the top plate 231 and the bottom plate 232 from the top points 241 of the guide path 24.

When the whole guide head 35 has been inserted between the top plate 231 and the bottom plate 232 from the top points 241 of the guide path 24 and the step portion 362 of the bridge 34 abuts on the guide peripheral plate portion 242, the locking claw 324 of the lock arm 32 engages with the locking opening 235 of the socket 20, so that the plug 30 and the socket 20 fit and engage with each other.

In the second embodiment, when the plug 30 is inserted into the socket 20, the front end of the step portion 36 is guided by the guide path 24 of the socket 20, and the relative postures of the plug 30 and the socket 20 are adjusted such that the longitudinal axes $A_1$, $A_2$ of the plug 30 and the socket 20 become parallel, thereby enabling smooth insertion of the plug 30 into the socket 20.

It should be noted that, although the present invention has been described above with reference to preferred embodiments, the scope of the invention is not limited thereto but includes various improvements and variations in the design as long as an object of the present invention can be achieved.

In molding the plug 30 and the socket 20, they can be formed by injection molding and the like and of any material such as synthetic resin and metal.

The engaging unit constituted of the lock arms, the operation opening and the locking opening has been exemplified above, but the engaging unit is not limited thereto and may be any arrangement.

The shapes of the guide path, axis path, step portion (guided member) and the like are not limited to those of the above-described embodiments and variants and may be changed as long as an object of the present invention can be achieved. Note that, when the guide path is provided to the socket, the width of the guide path at the front end side is preferably equal to or greater than half of the width of the insertion slot and more preferably equal to or greater than two thirds of that of the insertion slot.

And the angle of the guide path from the longitudinal axes $A_1$, $A_2$ as a centerline is preferably equal to or less than about 45 degrees and may be, for instance, about 35 degrees, 30 degrees or 15 degrees. This is because the plug can be smoothly guided into the socket by the guide peripheral portion when the plug is pushed with the step portion of the plug being abutted on the guide peripheral side surface of the guide path if the angle of the guide path is equal to or less than 45 degrees.

Figure 12:
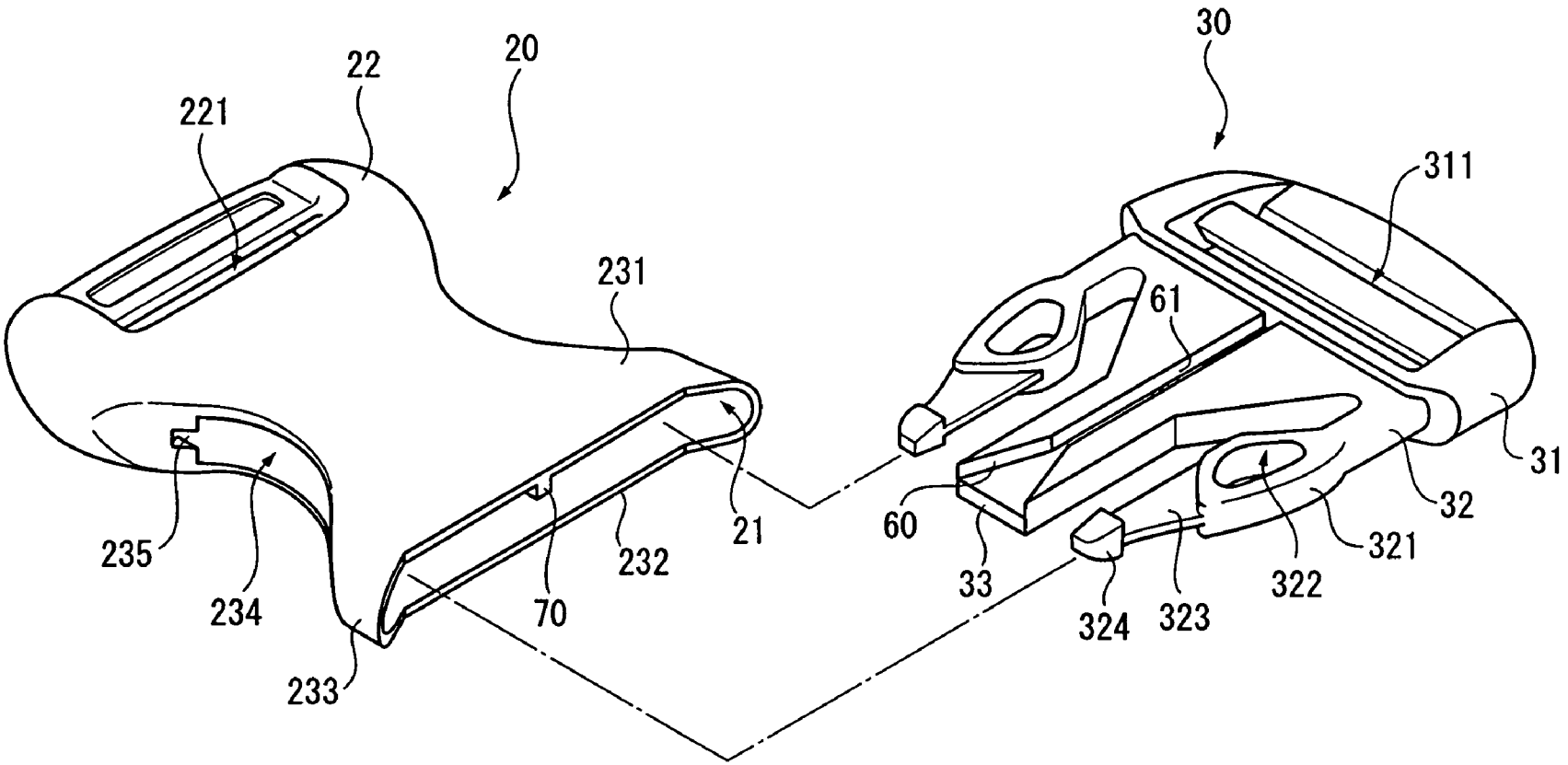
FIG. 12 is a perspective view showing a plug provided with a guide path and a socket provided with a guided member according to another variant of the present invention.

In the above-mentioned embodiments, the buckle in which the guide path is provided in the socket and the guided member (step portion) is provided in the plug has been exemplified. However, as shown in FIG. 12, a guide path 60 that becomes wider as being closer to the front end may be provided on the front end of the guide bar 33 of the plug 30, an axis path 61 extending from the guide path 60 toward the back end of the plug 30, and an protruding portion (guided member) 70 that engages with the guide path 60 and the axis path 61 may be provided on the inner surface on the front end side of the socket 20.

Although, in the above-mentioned embodiments, the buckle in which the socket 20 is constituted of the top plate 231, the bottom plate 232 and the side plates 233 and has a tubular shape has been exemplified, the socket may only have the top plate and the bottom plate but the side plates may be openings.

In the above-mentioned embodiments, the one connecting portion 33A that connects the pair of bridges 34 or bridges 52 to each other has been provided, but two or more connecting portion 33A may be provided. The connecting portion 33A may have any shape and may be, for instance, square bar shape, cylindrical or tabular. In addition, the connecting portion 33A may connect at the front end side like the bridges 34, or may connect in the middle portion like the bridges 52, or may connect at any other portion such as the back end portion.

The priority application Number JP2004-319903 upon which this patent application is based is hereby incorporated by reference.

What is claimed is:

1. A buckle, comprising:

a plug;

a socket into which the plug is inserted;

an engaging unit; and a posture-adjuster, wherein the plug includes:

a plug base;

a pair of lock arms extending from left and right side ends of the plug base toward a socket-insertion front end of the plug base; and a guide bar that is provided between the lock arms and has a predetermined length, the socket includes a top plate and a bottom plate forming top and bottom surfaces, the engaging unit includes the pair of lock arms, the engaging unit detachably engaging the plug and the socket in a state where the plug is inserted in the socket, the posture-adjuster includes:

a guide path provided on one of the plug and the socket and having a widening width; and a guided member provided to the other one of the plug and the socket and guided along the guide path, the posture-adjuster has an axis path extending from the guide path linearly along a longitudinal axis of the one of the plug and the socket, and the posture-adjuster adjusts relative postures of the plug and the socket when the plug is relatively moved toward the socket.

2. The buckle according to claim 1, wherein the guided member has a predetermined length.

3. The buckle according to claim 1, wherein the guide path is provided to the socket, and the guide path is provided to at least one of the top plate and the bottom plate.

4. The buckle according to claim 3, wherein the guide path provided to at least one of the top plate and the bottom plate has a width that is widened toward an insertion slot of the socket.

5. The buckle according to claim 1, wherein the guide path is provided to the socket and formed by guide peripheral portions provided on peripheral side surfaces of the top plate and the bottom plate that define a housing therebetween, the guided member including:

a guide bar that is provided to the plug and can be inserted into the socket; and a step portion that protrudes from the guide bar such that the step portion can abut on the guide peripheral portions when the guide bar is inserted in the socket.

6. The buckle according to claim 5, wherein the step portion has a through hole penetrating the step portion and the guide bar is defined to form a peripheral portion of the step portion.

7. The buckle according to claim 5, wherein the socket includes the top plate and bottom plate forming the top and bottom surfaces, and the guide bar includes held portions that are held between the top plate and the bottom plate when the guide bar is being inserted in the socket.

8. The buckle according to claim 5, wherein the guide bar includes a pair of bridges, and the pair of bridges are connected by a connecting portion to each other.

9. A buckle, comprising:

a plug;

a socket into which the plug is inserted;

an engaging unit; a posture-adjuster; and a locking portion, wherein the plug includes:

a plug base; and a pair of lock arms extending from left and right side ends of the plug base toward a socket-insertion front end of the plug base, the socket includes a top plate and a bottom plate forming top and bottom surfaces, the engaging unit includes the pair of lock arms, the engaging unit detachably engaging the plug and the socket in a state where the plug is inserted in the socket, the posture-adjuster includes:

a guide path provided on one of the plug and the socket and having a widening width; and a guided member provided to the other one of the plug and the socket and guided along the guide path, the posture adjuster adjusts relative postures of the plug and the socket when the plug is relatively moved toward the socket, and the locking portion includes a first locking portion provided on a front end of the lock arm and a second locking portion provided on the socket, the first locking portion being engaged with the second locking portion thereby locking the plug and the socket together.

10. The buckle according to claim 9, wherein a guide bar having a predetermined length is provided between the lock arms.

* * * * *